US006548955B1

(12) United States Patent
Compen et al.

(10) Patent No.: US 6,548,955 B1
(45) Date of Patent: Apr. 15, 2003

(54) CATHODE RAY TUBE WITH DEFLECTION UNIT

(75) Inventors: Johannes M. A. A. Compen, Eindhoven (NL); Gerardus V. A. Aben, Eindhoven (NL); Antonius J. Schillemans, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/501,739

(22) Filed: Feb. 11, 2000

(30) Foreign Application Priority Data

Feb. 12, 1999 (EP) ..... 99200404

(51) Int. Cl.[7] ..... H01J 31/00
(52) U.S. Cl. ..... 313/479; 313/480
(58) Field of Search ..... 313/479, 480; 252/500

(56) References Cited

U.S. PATENT DOCUMENTS 4,760,310 A * 7/1988 Deyama et al. ..... 313/479
5,793,494 A * 8/1998 Douken et al. ..... 358/254
5,906,720 A * 5/1999 Ferguson et al. ..... 204/488
RE36,429 E * 12/1999 Yamaguchi ..... 313/440
6,043,599 A * 3/2000 Nakane ..... 313/479

FOREIGN PATENT DOCUMENTS

| | | | |
|---|---|---|---|
| DE | 19619972 | 10/1997 | H01J/29/88 |
| EP | 0805474 A1 | 11/1997 | H01J/29/86 |
| EP | 0825219 | 2/1998 | C08G/61/12 |
| GB | 2265492 A | 9/1993 | H01J/29/06 |
| JP | 5266829 A | 10/1993 | H01J/29/88 |

* cited by examiner

*Primary Examiner*—Sandra O'Shea
*Assistant Examiner*—Anabel Ton

(57) ABSTRACT

A cathode ray tube (1) comprises an electrically conductive layer (10) shielding against alternating electric fields produced by the deflection unit (5). The electrically conductive layer (10), including an electrically conductive polymer, is provided on at least a part of the funnel portion (6) of the tube (1). The electrically conductive polymer is preferably chosen from the group of polythiophenes. Good results were obtained with a layer comprising poly-3,4-ethylene dioxythiophene. Application of this compound prevents the occurrence of damage to the tube by arcing phenomena and thus reduces the necessity of an insulating film between the tube (1) and the deflection unit (5).

4 Claims, 1 Drawing Sheet

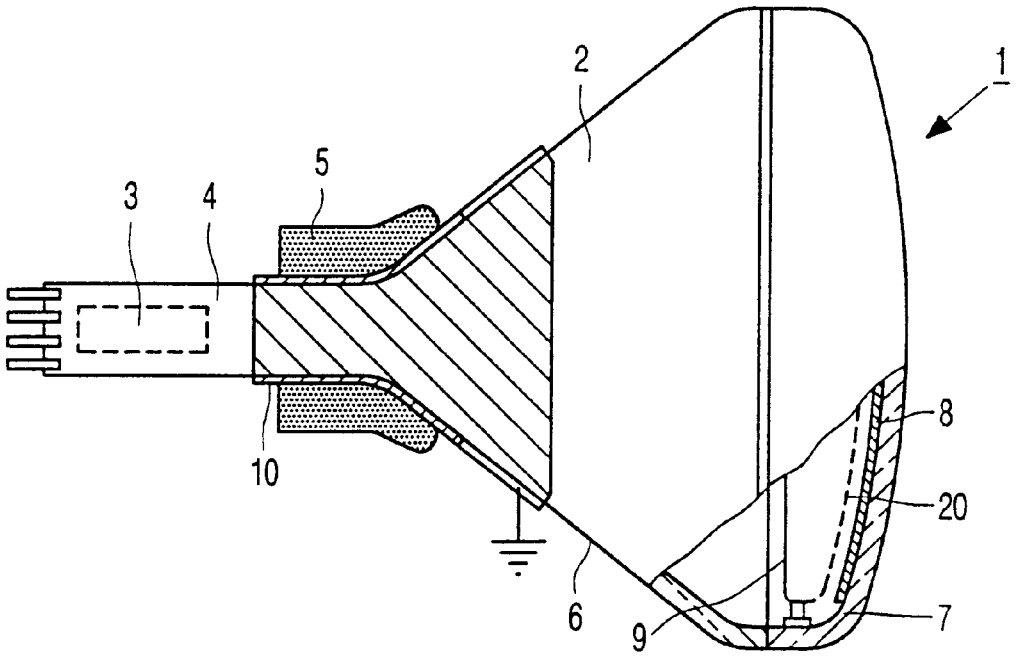
1
2
3
4
5
6
7
8
9
10
20

CATHODE RAY TUBE WITH DEFLECTION UNIT

FIELD OF THE INVENTION

The invention relates to a cathode ray tube comprising a funnel portion which is covered at least in part with an electrically conductive layer, and a deflection unit mounted on the funnel portion.

BACKGROUND AND SUMMARY OF THE INVENTION

A cathode ray tube wherein the funnel portion is covered with an electrically conductive layer is known. JP-A 05-266829 describes a cathode ray tube display device wherein a conductive material, e.g. graphite, is provided on a funnel portion, and a deflection unit is mounted on the cathode ray tube. Generally, cathode ray tubes (CRTs) comprise a number of undesired radiation sources.

An important source of radiation is the deflection unit which comprises coils generating an alternating electric current. In this connection, a method has been proposed in which an electrically conductive layer, e.g. graphite, is provided on the surface of the funnel portion, which is connected to ground to electrostatically shield the alternating electric field.

During operation of the cathode ray tube, unwanted electric discharges may occur at the position of the deflection unit. This phenomenon, known as arcing, may damage the cathode ray tube and possibly reduce its lifetime. To avoid the harmful consequences of the arcing phenomenon, an insulating film between the deflection unit and the graphite layer on the tube is commonly applied. However, the insulating film is an additional layer or component, which raises the costs of the cathode ray tube.

OBJECTS AND SUMMARY OF THE INVENTION

It is an object of the invention to provide a cathode ray tube wherein alternating electric fields generated by a deflection coil unit are shielded with an electrically conductive layer, which reduces the need of an additional insulating film.

The cathode ray tube according to the invention is characterized in that the electrically conductive layer comprises an electrically conductive polymer. The inventors have found that an additional insulating film may be omitted by applying an electrically conductive polymer.

The embodiment of claim 2 provides a class of electrically conductive polymers which have the additional advantage of being relatively cheap and easy to apply.

The embodiment of claim 3 provides an electrically conductive polymer which has the advantage of possessing self-healing properties when applied as a layer between the deflection unit and the funnel portion. In this respect, self-healing means that, if the arcing phenomenon occurs at a certain location during operation of the cathode ray tube, the properties of the polymer layer are changed at that particular location. In particular, locally the polymer is not electrically conductive anymore. Consequently, possible arcing phenomena do not lead to significant damage of the cathode ray tube.

The embodiment of claim 4 provides an electrically conductive layer having a sheet resistance equal to or lower than 1 kΩ/square. In practice it appeared that, with such a value, a good shielding of the occurring alternating electric field generated by the deflection unit is obtained. The notion sheet resistance (expressed in Ω/square) is explained on page 113 of the book "Device Electronics for Integrated Circuits", by R. S. Muller and Th. I. Kamins ($2_{nd}$ edition, John Wiley & Sons).

These and other aspects of the invention will be elucidated with reference to the embodiments described hereinafter.

BRIEF DESCRIPTION OF THE DRAWINGS

The drawing shows a side elevation, partly broken away, of a color cathode ray tube according to the invention.

DESCRIPTION OF THE PREFERRED EMBODIMENTS

The cathode ray tube 1 shown in the drawing comprises an evacuated glass envelope 2 with a neck portion 4, a funnel portion 6 and a front panel 7 having an inner surface on which a pattern of lines or dots of phosphor 8 luminescing in different colours may be arranged. During operation of the tube, an electron gun system 3, arranged in the neck, sends electron beams so that the phosphors will emit light. A deflection unit 5 mounted over the funnel portion 6 ensures that the electron beams systematically scan the pattern of phosphors 8 on the front panel 7. An electrically conductive layer 10 according to the invention is provided on the external surface of the envelope 2, which layer covers at least a part of the funnel portion 6 of the tube. The electrically conductive layer 10 comprises an electrically conductive polymer, preferably chosen from the group of polythiophenes. The electrically conductive layer 10 is connected to ground. In practice, the electrically conductive layer 10 appears to reduce the alternating electric field generated by the deflection unit 5.

EP 0 825 219 A2 describes the structure and properties of polymers belonging to the group of polythiophenes. These polymers comprise a repetitive chain of n units (n ranging between 5 and 100) of the monomer indicated in formula I of the cited document. Additives may be used to further adapt the polymer properties.

In practice, good shielding properties against the alternating electric fields were obtained by the application of a layer comprising poly-3,4-ethylene dioxythiophene at the funnel portion of the cathode ray tube. It has been found that layers with a sheet resistance equal to or below 1kΩ/square were satisfactory.

Poly-3,4-ethylene dioxythiophene shows self-healing characteristics. This means that, in the case of occurrence of an electric discharge at a certain spot, the conductive layer stops conducting the current at that particular spot. Hence, damage to the tube 1 is prevented and the need for an additional insulating film between envelope 2 and the deflection unit 5 is reduced or avoided.

Good results were also obtained by the application of a layer 10 comprising polyaniline or polypyrole.

In summary, the invention relates to a cathode ray tube 1 which comprises an electrically conductive layer 10 shielding against alternating electric fields produced by the deflection unit 5. The electrically conductive layer 10, including an electrically conductive polymer, is provided on at least a part of the funnel portion 6 of the tube 1. The electrically conductive polymer is preferably chosen from the group of polythiophenes. Good results were obtained with a layer comprising poly-3,4-ethylene dioxythiophene. Application of this compound prevents the occurrence of damage to the tube by arcing phenomena and thus reduces the necessity of an insulating film between the tube 1 and the deflection unit 5.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim.

What is claimed is:

1. A cathode ray tube comprising:

a funnel portion covered at least in part with an electrically conductive layer that comprises an electrically conductive polymer applied on an external surface of the funnel portion; and a deflection unit mounted on the funnel portion.

2. The cathode ray tube of claim 1, wherein the electrically conductive polymer comprises a polymer chosen from the group of polythiophenes.

3. The cathode ray tube of claim 2, wherein the electrically conductive polymer comprises poly-3,4-ethylene dioxythiophene.

4. The cathode ray tube of claim 1, wherein the value of the sheet resistance of the electrically conductive layer is equal to or lower than 1kΩ/square.

* * * * *